US006718918B2

(12) United States Patent
Meintschel et al.

(10) Patent No.: US 6,718,918 B2
(45) Date of Patent: Apr. 13, 2004

(54) DEVICE FOR ACTUATING A GAS EXCHANGE VALVE

(75) Inventors: Jens Meintschel, Esslingen (DE); Oliver Meister, Uhingen (DE); Thomas Stolk, Kirchheim/Teck (DE); Alexander von Gaisberg, Fellbach (DE)

(73) Assignee: DaimlerChrysler AG, Stuttgart (DE)

( * ) Notice: Subject to any disclaimer, the term of this patent is extended or adjusted under 35 U.S.C. 154(b) by 0 days.

(21) Appl. No.: 10/131,506

(22) Filed: Apr. 19, 2002

(65) Prior Publication Data

US 2002/0157622 A1 Oct. 31, 2002

(30) Foreign Application Priority Data

Apr. 25, 2001 (DE) ..... 101 20 401

(51) Int. Cl.[7] ..... F01L 9/04

(52) U.S. Cl. ..... 123/90.11; 251/129.01; 251/129.15

(58) Field of Search ..... 251/129.01, 129.15, 251/129.09, 129.1, 129.2; 335/220, 256, 282, 276; 123/90.11

(56) References Cited

U.S. PATENT DOCUMENTS

| | | | | | |
|---|---|---|---|---|---|
| 4,762,095 | A | * | 8/1988 | Mezger et al. | 123/90.11 |
| 4,867,111 | A | * | 9/1989 | Schneider et al. | 123/90.11 |
| 5,117,213 | A | * | 5/1992 | Kreuter et al. | 335/219 |
| 5,431,010 | A | * | 7/1995 | Stone | 60/204 |
| 6,157,277 | A | | 12/2000 | Bulgatz et al. | |

FOREIGN PATENT DOCUMENTS

| | | | | |
|---|---|---|---|---|
| DE | 196 28 860 | | 1/1998 | |
| FR | 2 792 451 | | 10/2000 | |
| JP | 405202717 | A * | 8/1993 | 123/490 |

* cited by examiner

*Primary Examiner*—Thomas Denion
*Assistant Examiner*—Jaime Corrigan
(74) *Attorney, Agent, or Firm*—Klaus J. Bach

(57) ABSTRACT

In a device for actuating at least one gas exchange valve of an internal combustion engine, comprising at least one pivoting armature, which is operatively connected to the gas exchange valve, and at least one first and at least one second electromagnetic units for actuating the pivoting armature, the pivoting armature is included in a first functional group with an armature housing and at least one of the two electromagnetic units is included in a second functional group and the functional groups are interconnected by connection means.

9 Claims, 5 Drawing Sheets

DEVICE FOR ACTUATING A GAS EXCHANGE VALVE

BACKGROUND OF THE INVENTION

The invention relates to a device for actuating a gas exchange valve of an internal combustion engine with a pivot armature actuated by electromagnetic drive units.

DE 196 28 860 A1 discloses a generic device for actuating a gas exchange valve of an internal combustion engine. This device, designed as an electromagnetic actuator, comprises two electromagnetic units, of which one acts in the opening direction and one in the closing direction of the valve. By means of the two electromagnetic units, a pivoting armature can be actuated, which is operatively connected to the gas exchange valve via a valve stem. The pivoting armature and the two electromagnetic units are arranged in a common housing. The pivoting armature is mounted in the housing via a rotary shaft.

It is the object of the present invention to provide a device for actuating a gas exchange valve of an internal combustion engine, which can easily be adjusted so that a minimal air gap remains when the pivoting armature is pivoted towards one of the electromagnetic units.

SUMMARY OF THE INVENTION

In a device for actuating at least one gas exchange valve of an internal combustion engine, comprising at least one pivoting armature, which is operatively connected to the gas exchange valve, and at least one first and at least one second electromagnetic unit, which serve for actuating the pivoting armature, the pivoting armature is included in a first functional group together with an armature housing and the two electromagnetic units are included in a second and third functional groups and the functional groups are interconnected by connection means.

The division of the device into functional groups makes it possible first to assemble the components of the respective functional group and, before the connection of the functional group, to subject the components to machining, in particular precision machining, such as grinding, fine milling, etc., so that distortions which may possibly occur during the assembly of the respective components are eliminated. The active surfaces of the individual functional groups, after their assembly, are freely accessible to an extent such that they can be subjected to machining. In particular, active surfaces of the respective functional groups, that is to say the active surfaces of the pivoting armature and the respective active surfaces, usually formed by a yoke, of one of the two electromagnetic units, can be subjected to machining in such a way that, after the inter-connection of the functional groups, and in a corresponding pivot position of the pivoting armature, there is no, or only a minimal, air gap between these active surfaces. Minimal tolerances can be achieved, for example, by grinding.

Furthermore, it is possible, during machining, to apply deformations to which the respective functional group is subjected when the device is in operation, so that, when the device is in operation, in a corresponding position of the pivoting armature, a clearance, which is constant over the active surfaces or no clearance at all, is present between the respective active surfaces.

The connection means may serve at the same time for connecting the functional groups to one another and for fastening the device, for example, to an actuator carrier or a cylinder head.

It is possible, for example, that the pivoting armature and one of the electromagnetic units are part of the first functional unit and the other electromagnetic group is part of the second functional group. However, in order that active surfaces are oriented optimally in relation to one another both in the opening position of the pivoting armature and in the closing position of the pivoting armature, the device according to the invention advantageously comprises a third functional group which is assigned to one of the two electromagnetic units and which is connected to the first functional group via connection means. It is thereby possible to subject both the opening-side and the closing-side active surfaces to machining, in particular precision machining, before the connection of the functional groups.

According to one advantageous embodiment of the invention, the connection means comprise at least one rod-like fastening arrangement. This is preferably a threaded bolt. It is also conceivable, however, to have, for example, a rod-like fastening arrangement such as a threaded rod. By means of a rod-like arrangement, the individual functional groups can be connected to one another so as to be essentially stress-free. Furthermore, the rod-like fastening arrangement may also be used in a simple way for fastening the device according to the invention to an actuator carrier, a cylinder head or the like. However, other devices which seem appropriate to a person skilled in the art and by means of which the functional groups can be connected to one another and fixed are also suitable as connection means.

The armature housing is advantageously of frame-like design, and it serves for mounting the at least one pivoting armature. Such a configuration of the armature housing provides for a reliable and protected receptacle for the pivoting armature, and engagement points for the rod-like arrangement for connecting the functional groups can be introduced into the receptacle in a simple way.

The second and/or the third functional group may correspondingly comprise a first or a second receptacle device which are of essentially frame-like design. The armature housing and the receiving device may for example be welded together from individual parts or may be cast. They are expediently configured in such a way that they are provided in each case with stiffening means. For example, the receiving devices each comprise a main frame and a side frame, between which the respective electromagnetic unit is fastened and, if appropriate, one or more rigid flexion beams attached to the end face. The receiving devices thus form reliable and dimensionally stable receptacles for the respective electromagnetic unit.

The connection means expediently are connected to the frame-like receptacle for the first and/or the second functional group. In particular the functional groups may be braced, via at least one connection means in the form of a threaded bolt, in such a way that the latter extends into a bore of the two frame-like receptacles and a bore of the frame-like armature housing.

The device according to the invention can be adjusted particularly effectively when the active surfaces of the first and of the second electromagnetic unit are oriented in parallel. In this case, the frame-like receptacles for the electromagnetic units and the armature housing are expediently oriented essentially in parallel.

Particularly when the active surfaces of the electromagnetic units are oriented in parallel, it is advantageous if the pivoting armature is wedge-shaped. This ensures that the active surface of the electromagnetic unit and the respective active surface of the pivoting armature, when the latter is pivoted towards this electromagnetic unit, are oriented essentially in parallel, so that a minimal holding power has to be applied. In particular, in this case, the machining of the active surfaces before the connection of the functional groups may be carried out in such a way that, first, the functional group comprising an electromagnetic unit is placed onto the functional group comprising the pivoting armature and, then, an electromagnetic unit is energized, so that the pivoting armature is pulled up by a yoke, for example the valve opening yoke of the electromagnetic unit. An erosive medium is then introduced between the pivoting armature and the yoke and the two functional groups are moved in an oscillating motion relative to one another essentially parallel to the active surfaces. The second active surface of the pivoting armature and the active surfaces of the yoke, for example the valve closing yoke assigned to the second electromagnetic unit, are thereafter treated in a corresponding way.

The device according to the invention may be designed as a double actuator, so that it can serve for a simultaneous actuation of two gas exchange valves.

The invention will become more readily apparent from the following description of exemplary embodiments of the device according to the invention on the basis of the accompanying drawings.

DESCRIPTION OF EMBODIMENTS

Figure 1:
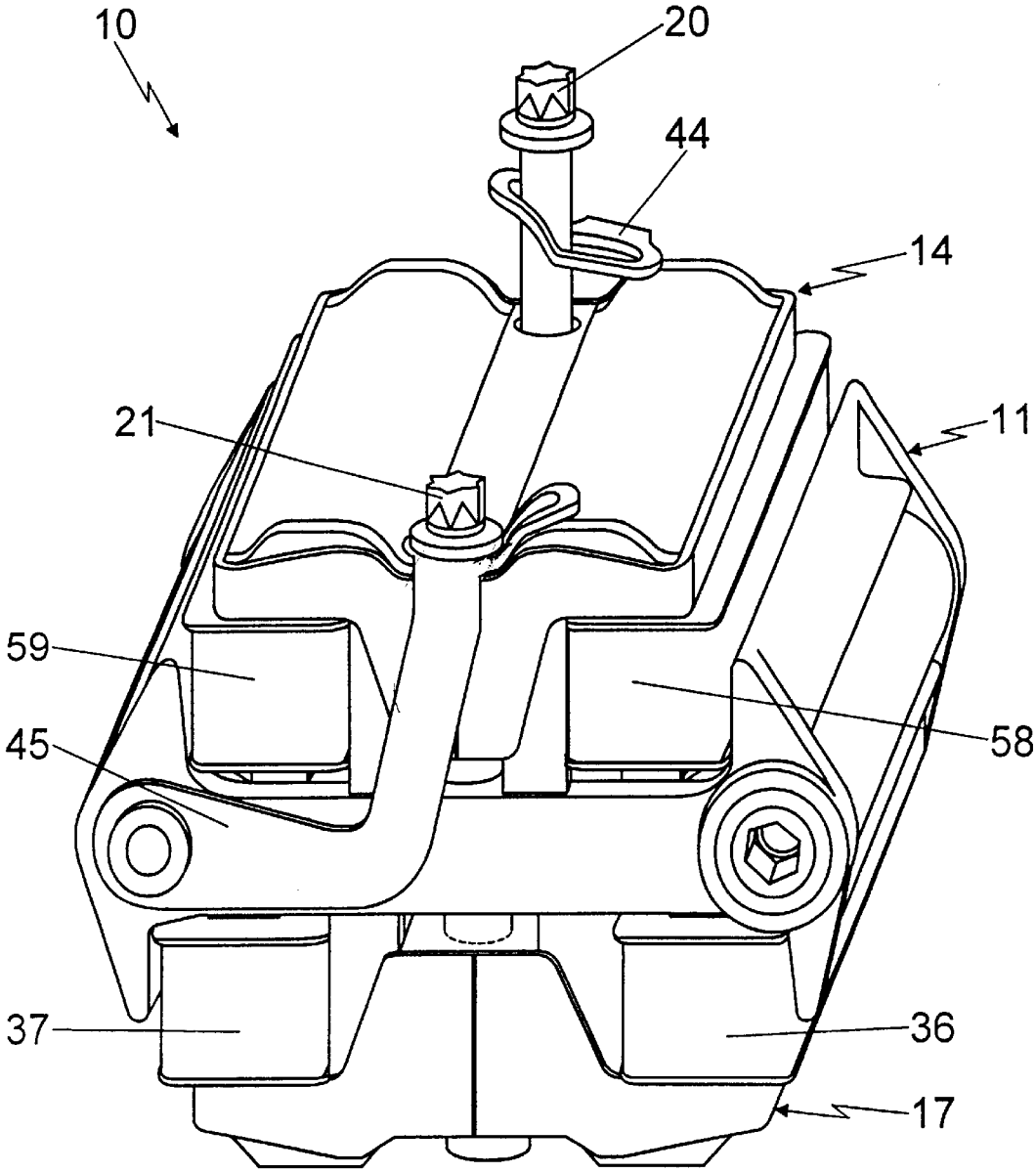
FIG. 1 is a perspective view of a double actuator arrangement.
Figure 2:
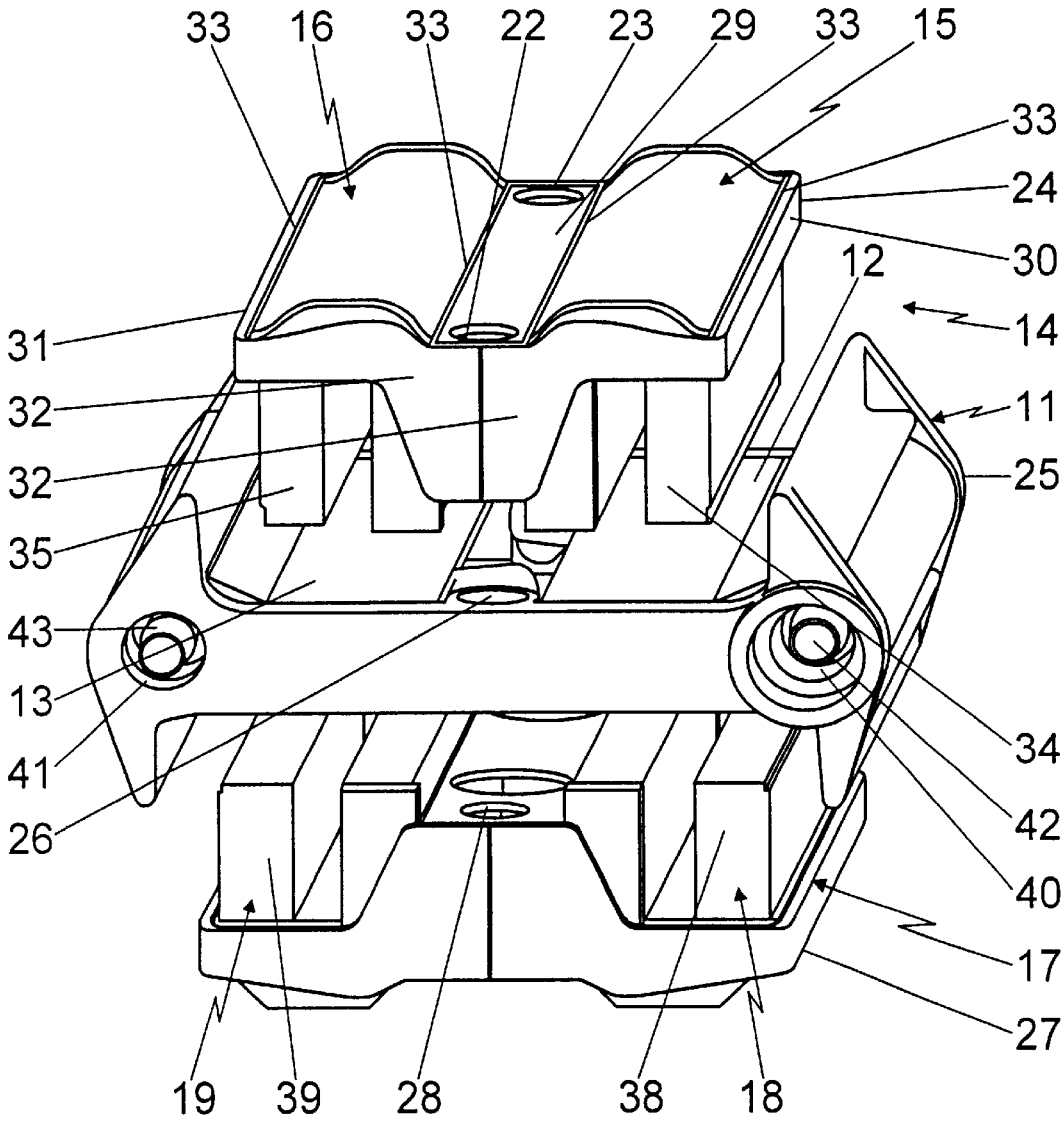
FIG. 2 shows three functional groups of the actuator according to FIG. 1.
Figure 3:
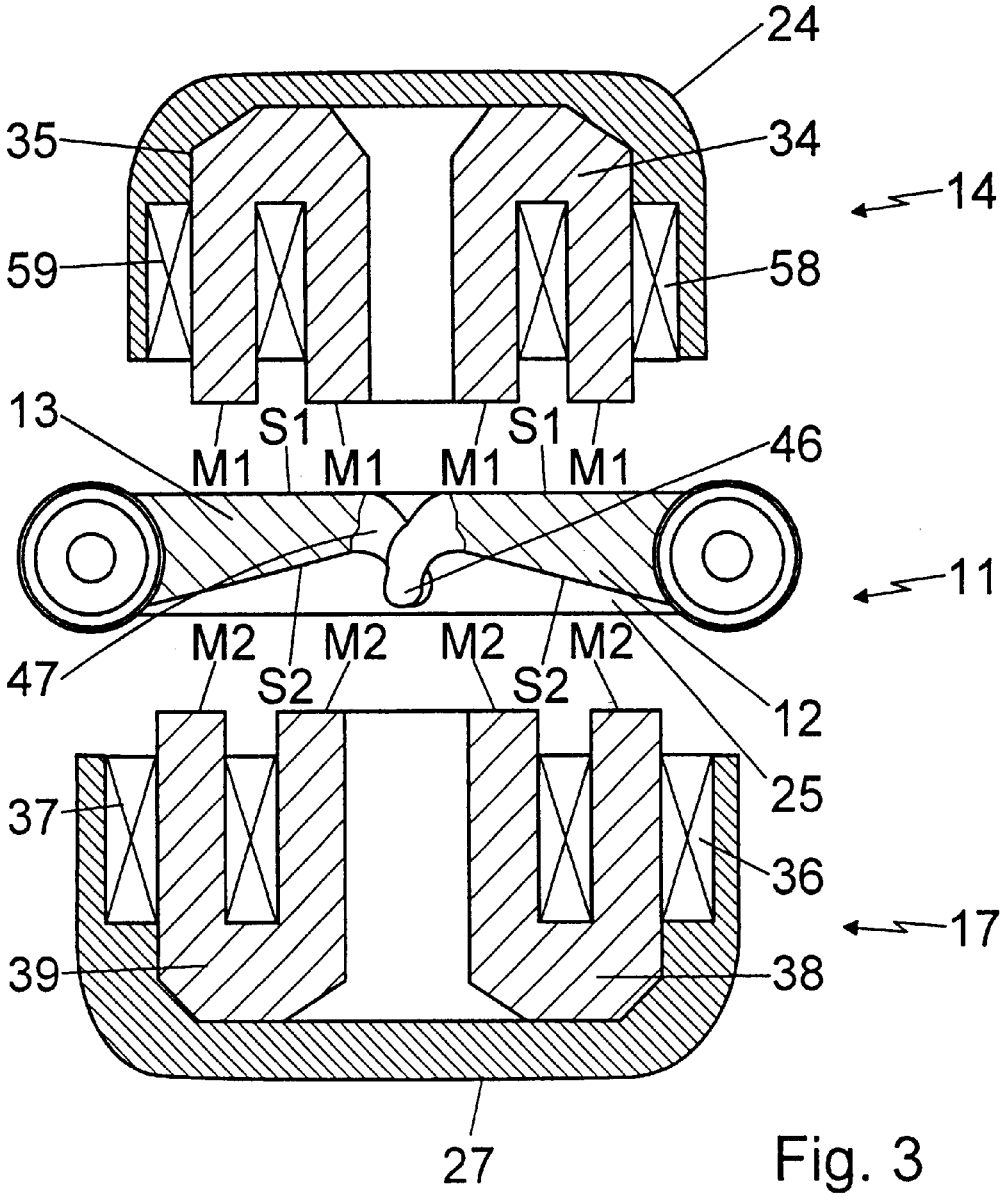
FIG. 3 shows the three functional groups according to FIG. 2, without respective housings, in a cross sectional view.

FIGS. 1 to 3 illustrate an electromagnetic double actuator 10, what is referred to as a twin actuator, which serves for actuating two gas exchange valves, not shown, of an internal combustion engine for motor vehicles, which is likewise not illustrated.

The double actuator 10 is composed essentially of three functional groups, a first functional group 11, which comprises two pivoting armatures 12 and 13, a second functional group 14, which serves for closing the gas exchange valves and, for this purpose, comprises two electromagnetic units 15 and 16 in the form of electromagnets, and a third functional group 17, which serves for opening the gas exchange valves and, for this purpose, comprises two electromagnetic units 18 and 19 in the form of electromagnets.

The functional groups 11, 14 and 17 are connected to one another via common connection means 20 and 21 in the form of threaded bolts. The threaded bolts 20 and 21 also serve for fastening the double actuator 10 to an actuator carrier, which is not illustrated here.

The threaded bolts 20 and 21 extend in each case through a bore 22 and 23 of a structure 24, of the second functional group 14, in through bores 26 of a frame-like armature housing 25 of the first functional group 11, of which only the bore 26 is visible in from the drawing, and through bores 28 of a receiving structure frame 27, of the third functional group 17, of which only the bore 28 is visible in the drawing. The armature housing 25 is formed by a casting.

The second functional group 14 is constructed in such a way that the receiving frame structure 24 comprises a main frame 29 which is arranged between the two electromagnetic units 15 and 16 and is connected to two side frames 30 and 31, which in each case surround an electromagnetic unit 15 and 16. The receiving frame 24 is stiffened on the end face by strengthening beams 32. The electromagnetic units 15 and 16 are welded into the receiving frame 24 via weld seams 33.

The electromagnetic units 15 and 16 of the second functional group 14, which are closing magnets, comprise magnet coils 58 and 59, which are not illustrated in FIG. 2 for the sake of clarity. The magnet coils cooperate with coil cores 34 and 35, respectively, which are designed as yokes and are provided, on the end faces facing the pivoting armatures 12 and 13, with active magnet surfaces or magnet pole faces M1. The pole faces M1 cooperate with active pivoting-armature surfaces or pivoting-armature pole faces S1 illustrated at the top in FIG. 3, of the pivoting armatures 12 and 13.

The receiving frame 27 of the third functional group 17 is constructed according to the receiving frame 24 of the second functional group 14 and receives the two electromagnetic units 18 and 19 which are designed opening magnets. Each has a magnet coil 36 or 37 and a coil core 38 or 39 cooperating with the respective magnet coil, which is in the form of a yoke. The yokes 38 and 39 have, at the end faces facing the pivoting armatures 12 and 13, active magnet surfaces or magnet pole faces M2 which cooperate with active pivoting-armature active surfaces or pivoting-armature pole faces S2 of the pivoting armatures 12 and 13.

The active surfaces S1, S2 of the pivoting armatures 12 and 13 and the active surfaces M1 and M2 of the yokes 34, 35 and 38, 39 are visible, in particular, in FIG. 3.

The pivoting armatures 12 and 13 are mounted in two bearings 40 and 41, which are formed in the frame-like armature housing 25. Furthermore, in the built-in position, the pivoting armatures 12 and 13 are biased in the pivot direction toward the third functional group 17, that is to say in the valve opening direction, by means of torsion bar springs 42 and 43.

In the assembled double actuator 10, the torsion bar springs 42 and 43 are pre-stressed by means of the threaded bolts 20 and 21 via lever-like transmission elements 44 and 45. The levers 44 and 45 are welded to the torsion bar springs 42 and 43 and each has an opening, through which the threaded bolt 20 or 21 extends. The heads of the threaded bolts 20 and 21 engage the levers 44 and 45 and thus hold the torsion bar springs 42 and 43 under pre-stress.

When inserted into the armature housing 25, the torsion bar springs 42 and 43 are stress-free. They are then pre-stressed by the bolts 20 and 21 being screwed into corresponding threads. The bolts 20 and 21, which also serve for fastening the double actuator 10, form each a spring-stressing structure for the torsion bar springs 42 and 43.

In the illustration in FIG. 2, in addition to the magnet coils 36, 37, 58 and 59, the screw bolts 20 and 21 and the levers 44 and 45 are also not illustrated for the sake of clarity.

FIG. 3 illustrates the functional groups 11, 14 and 17, without the associated frames 24, 25 or 27. It is apparent from FIG. 3 that the active surfaces M1 on the end faces of the yokes 34 and 35 and the active surfaces M2 on the end faces of the yokes 38 and 39 are oriented in parallel. The pivoting armatures 12 and 13 are wedge-shaped and have a nose-like projection 46 and 47, by means of which the pivoting armature 12 or 13 cooperates, via a valve stem, not illustrated here, with the respective gas exchange valve of the internal combustion engine. When the pivoting armature 12 or 13 is pivoted towards the respective yoke 34 or 35 which are valve closing yokes, the active surface S1 formed on the pivoting armature 12 or 13 is parallel to the active surfaces M1 formed on the end faces of the yokes 34 and 35. The active surfaces M2 formed on the yokes 38 and 39, which are valve opening yokes, are correspondingly oriented parallel to the respective active surface S2 and the pivoting armature 12 and 13 when they are pivoted towards the respective valve opening yokes 38 and 39.

Figure 4:
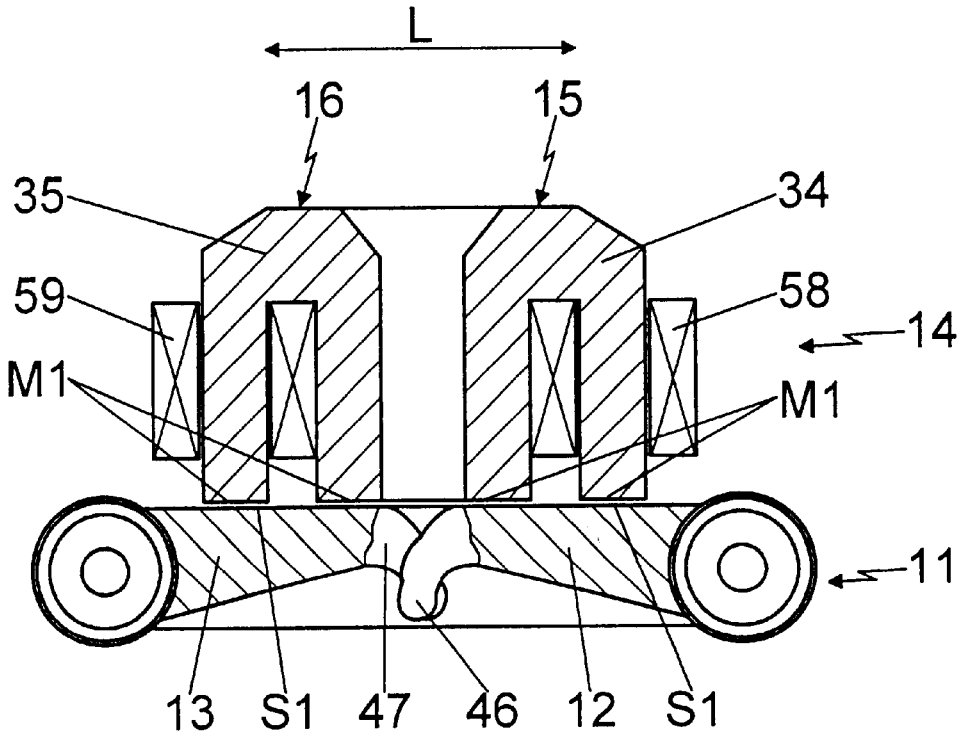
FIG. 4 shows the arrangement of two functional groups of the double actuator according to FIG. 1 during grinding.

FIG. 4 illustrates diagrammatically a grinding machining for the active surfaces M1 of the yokes 34 and 35 and of the active surfaces S1 of the pivoting armatures 12 and 13. By means of this method, the active surfaces S1 and M1 are finely adjusted. For this purpose, the functional group 14, after being assembled, is placed onto the first functional group 11. The electromagnetic units 15 and 16 are then energized, so that the pivoting armatures 12 and 13 are pulled towards the yokes 34 and 35. A lapping medium is introduced between the yokes 34 and 35 on one side and the pivoting armatures 12 and 13 on the other side. The lapping medium is formed, for example, from a suspension of water with a lapping grain, such as corundum, silicon carbide, boron carbide or the like. The functional group 14 is thereafter moved on the functional group 11 in an oscillating lapping movement as indicated by the double arrow L, so that an effective surface wear takes place on the lapping surfaces, that is, the active surfaces S1 and M1. Any air gap between the active surfaces M1 and S1 is thereby minimized. The lapping movement may also be circular.

During grinding, the pivoting armatures 12 and 13 are engaged with the forces which act on the pivoting armatures 12 and 13 when the internal combustion engine is in operation, so that, during grinding, the deformations of the yokes 34 and 35 and of the pivoting armatures 12 and 13 occurring during the operation of the actuator are taken into account and, consequently, a necessary profiling of the pivoting-armature and yoke active surfaces S1 and M1, which generates minimal air gaps during operation, is automatically achieved.

Figure 5:
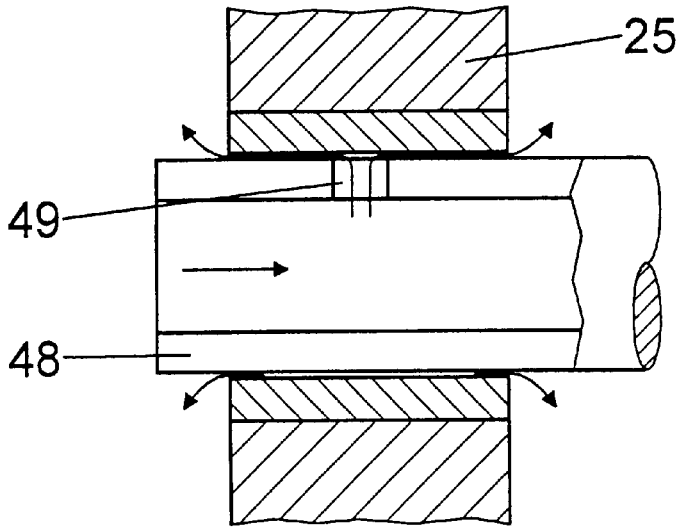
FIG. 5 shows an operation to flush a bearing area of a pivoting armature.

During grinding, the bearing areas of the pivoting armatures 12 and 13 are flushed, in order to prevent lapping medium from penetrating into its surfaces. This is illustrated in FIG. 5. Flushing is carried out, for example, with air, water, oil or the like. The flushing medium is introduced into a hollow shaft 48 of the respective pivoting armature 12 or 13 and then flows via an orifice 49 in the shaft 48 through the respective bearing areas.

Varying currents are applied to the magnet coils 58 and 59 during grinding, so that the active surfaces S1 and M1 are machined with different engagement forces of the pivoting armatures 12 and 13 on the magnet active surfaces M1.

Figure 6:
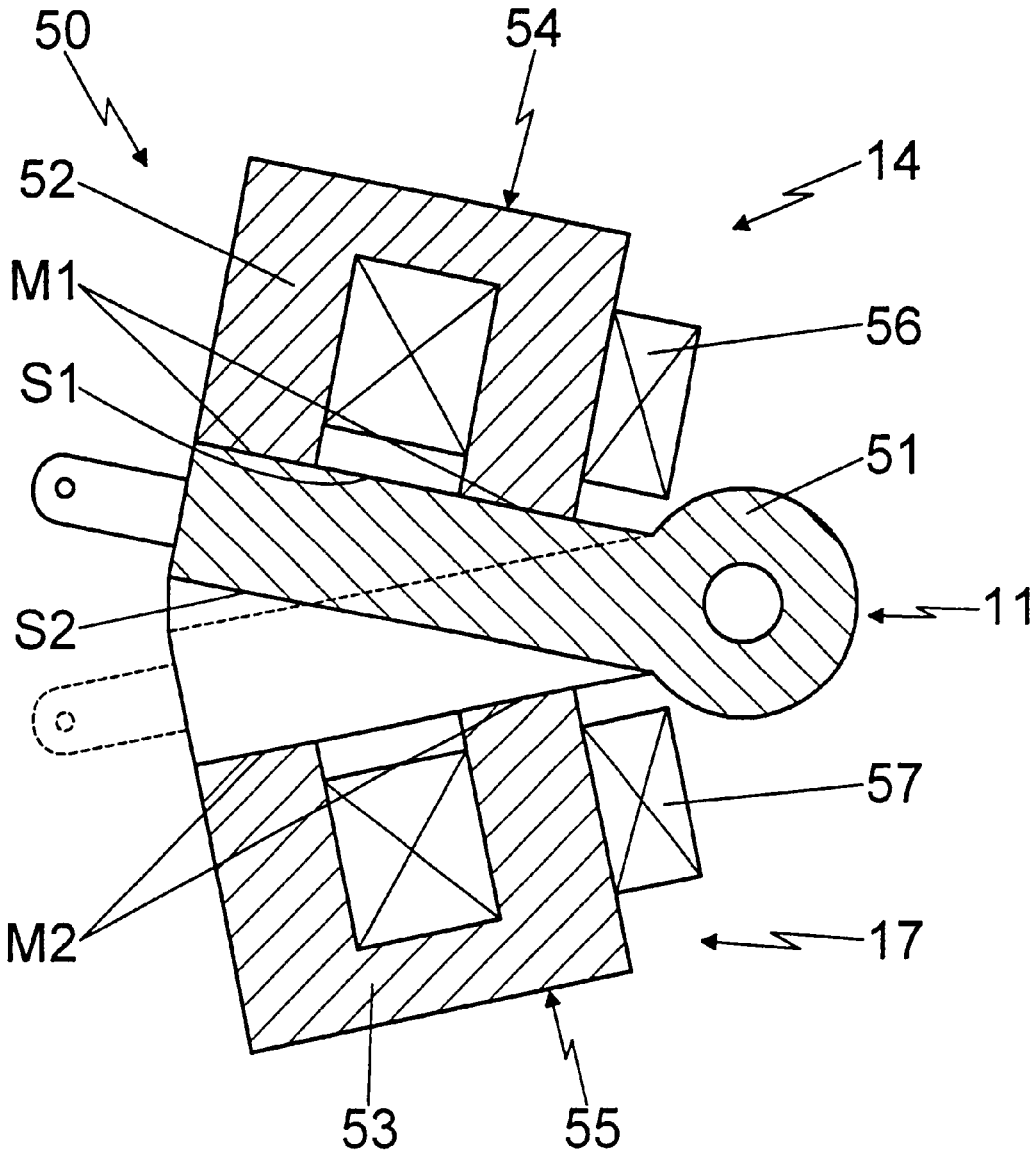
FIG. 6 shows an alternative embodiment of an electromagnetic actuator in a diagrammatic cross-sectional view.

FIG. 6 illustrates an alternative embodiment of an electromagnetic actuator 50. Components remaining essentially the same are numbered with the same reference symbols. Reference may therefore be made to the description of the exemplary embodiment according to FIGS. 1 to 3.

The electromagnetic actuator likewise comprises a first functional group 11 with an armature housing, not illustrated here, a second functional group 14 with a support housing, likewise not illustrated here, and a third functional group 17 with a support housing, likewise not illustrated here. The armature housing and the support housing may be of essentially frame-like design and are connected to one another via suitable connection means not illustrated here.

The first functional group 11 comprises a pivoting armature 51 having two active surfaces S1 and S2 which are oriented parallel to one another. The active surface S1 is assigned two active surfaces M1 of an electromagnet 54 which are formed on a valve closing yoke 52 which cooperates with a magnet coil 56. The active surface S2 is assigned to active surfaces M2 of an electromagnet 55 which are formed on a valve opening yoke 53, which cooperates with a magnet coil 57. The active surfaces M1 of the valve closing yoke 52 and the active surface M2 of the valve opening yoke 53 span an acute angle. In the closing position, the pivoting armature 51 bears against the valve closing yoke 52. In the opening position, which is illustrated by broken lines, the pivoting armature 51 bears against the valve opening yoke 53.

What is claimed is:

1. A device for actuating at least one gas exchange valve of an internal combustion engine, comprising for each gas exchange valve a pivoting armature pivotally supported in an armature housing and operatively connected to the gas exchange valve, and a first and a second electromagnetic unit for actuating each pivoting armature, said pivoting armatures and said armature housing forming a first pre-assembled functional group and said first and said second electromagnetic units forming second and respectively third pre-assembled functional groups and said first, second and third pre-assembled functional groups being interconnected and mounted by connection means, said pivoting armatures being mounted on a pivot shaft which is rotatably mounted in said armature housing and torsion bars connected to said pivot shaft for biasing said pivoting armatures in the valve opening direction and levers extending from said torsion bars to said connection means for pre-stressing said torsion bars upon mounting of said connection means.

2. A device according to claim 1, wherein said connection means comprise at least one threaded bolt extending through said pre-assembled functional groups.

3. A device according to claim 1, wherein said armature housing is of frame-like design and supports said pivoting armatures.

4. A device according to claim 3, wherein said second pre-assembled functional group comprises a first essentially frame-like support structure.

5. A device according to claim 4, wherein said third pre-assembled functional group comprises a second essentially frame-like support structure.

6. A device according to claim 5, wherein said connection means engage the frame-like support structures of said first, second and third pre-assembled functional groups.

7. A device according to claim 1, wherein said first electromagnetic unit and said second electromagnetic unit have active engagement surfaces, which are oriented in parallel.

8. A device according to claim 7, wherein the pivoting armature is wedge-shaped for abutting engagement with said parallel engagement surfaces.

9. A device according to claim 1, herein said torsion bars extend through said pivot shaft.

* * * * *